US005924392A

United States Patent [19]

Hall

[11] Patent Number: 5,924,392

[45] Date of Patent: Jul. 20, 1999

[54] BOTTOM PAD/FOAM DAM APPARATUS FOR WATER HEATERS

[75] Inventor: W. Jason Hall, Montgomery, Ala.

[73] Assignee: Rheem Manufacturing Company, New York, N.Y.

[21] Appl. No.: 09/145,093

[22] Filed: Sep. 1, 1998

[51] Int. Cl.[6] ..... F22B 37/36

[52] U.S. Cl. ..... 122/494; 220/694.1

[58] Field of Search ..... 122/13.1, 494; 220/694.1, 592.2, 592.25; 264/46

[56] References Cited

U.S. PATENT DOCUMENTS

| | | | |
|---|---|---|---|
| 4,452,226 | 6/1984 | Daugirda et al. | 126/373 |
| 4,477,399 | 10/1984 | Tilton | 264/45.2 |
| 4,844,049 | 7/1989 | Nelson | 122/13 A |
| 4,860,728 | 8/1989 | Nelson | 122/494 |
| 4,865,014 | 9/1989 | Nelson | 126/361 |
| 4,904,428 | 2/1990 | West et al. | 264/46.5 |
| 5,020,481 | 6/1991 | Nelson | 122/494 |
| 5,115,767 | 5/1992 | West et al. | 122/494 |
| 5,154,140 | 10/1992 | Windon | 122/494 |
| 5,180,077 | 1/1993 | Lewis | 220/729 |
| 5,460,290 | 10/1995 | Hanning et al. | 220/421 |

FOREIGN PATENT DOCUMENTS 2062015 10/1994 Canada .

*Primary Examiner*—Teresa Walberg
*Assistant Examiner*—Gregory A. Wilson
*Attorney, Agent, or Firm*—Konneker & Smith, P.C.

[57] ABSTRACT

A water heater is provided with a specially designed molded bottom pad/foam dam member which is placed in its bottom pan prior to placing bottom annular portions of the water heater tank and its outwardly spaced jacket structure into the bottom pan. The pad/dam member functions to automatically center the tank relative to its jacket structure, and to prevent leakage past the bottom pan of liquid foam insulation injected into the tank/jacket annulus after bottom end portions of the tank and jacket are secured within the bottom pan. The top side of the pad/dam member has three concentric annular grooves formed therein. The outermost first groove receives an annular bottom end portion of the jacket, while a second groove receives an annular bottom end portion of the tank. The provision of the third groove permits the same pad/dam member to be alternatively used with a water heater having a different tank diameter to thereby improve the manufacturing efficiency of a line of differently sized water heaters. When a second water heater having a different tank diameter is used with the bottom pad/foam dam member, annular bottom edge portions of the second water heater's jacket and tank portions are respectively received in the first and third top side grooves in the pad/dam member.

19 Claims, 1 Drawing Sheet

BOTTOM PAD/FOAM DAM APPARATUS FOR WATER HEATERS

BACKGROUND OF THE INVENTION

The present invention generally relates to liquid heating apparatus and, in a preferred embodiment thereof, more particularly relates to a specially designed bottom pad/foam dam member positionable under the tank and outer jacket portions of a water heater.

As conventionally constructed, a water heater typically has a tank portion adapted to hold a quantity of water to be heated, an outer jacket structure outwardly circumscribing the vertical tank side wall portion and forming an annular insulation space therewith, and a quantity of insulation disposed in this annular space. The bottom end of the tank/jacket structure is typically placed into a circular bottom pan structure and suitably secured thereto.

A common method of placing insulation in the tank/jacket annulus, after a bottom portion of the tank/jacket structure secured within the bottom pan, is to simply inject liquid foam insulation into the annulus and let the injected foam cure therein. As is well known in this art, pressurized injected liquid insulation foam has an undesirable propensity for leaking out of the tank/jacket annulus—particularly at the interface between the bottom pan and the bottom tank/jacket portion received therein. In order to contain the injected liquid foam within the tank/jacket annulus, a variety of "dam" structures have previously been utilized to seal various leak paths leading outwardly from the annulus.

To block outward injected foam insulation leakage at the bottom pan, one proposed solution has been to install a bottom pad/foam dam member in the bottom pan and then rest the bottom end portion of the tank/jacket structure on the pad/dam member which is configured to block outward flow of injected foam insulation outwardly from the tank/jacket annulus adjacent the bottom pan. Examples of these previously proposed bottom pad/foam dam members may be found in U.S. Pat. No. 5,154,140 and Canadian Patent 2,062,015.

A primary disadvantage of these previously proposed bottom pad/foam dam members is that each is adapted for use only with a water heater having a certain tank diameter and jacket diameter. If a water heater having a different tank diameter is provided, a differently configured pad/dam member is required. Accordingly, in a given line of water heaters produced by a manufacturer and having different tank diameters, a differently configured pad/dam member has to be provided for each different water heater model. A need thus exists for a bottom pad/foam dam member which is not limited in this manner. It is to this need that the present invention is directed.

SUMMARY OF THE INVENTION

In carrying out principles of the present invention, in accordance with a preferred embodiment thereof, a liquid heating device, representatively a water heater is provided with a specially configured bottom pad/foam dam member that is received in a bottom pan portion of the water heater and is used to support the tank and outer insulation jacket portions of the water heater in a manner operatively positioning the insulation jacket relative to the tank portion, and preventing outflow at the bottom pan of liquid foam insulation injected Into an insulation space between the insulation jacket and the water storage tank portion of the water heater.

The liquid heating device, in an illustrated preferred water heater embodiment thereof, includes a tank structure centered about a vertically orientable axis and adapted to contain a quantity of liquid to be heated, the tank structure having a bottom vertical end edge portion circumscribing the axis. A jacket outwardly and coaxially circumscribes the tank structure and forms an insulation space therebetween, the jacket having a bottom vertical end edge portion circumscribing the axis. In constructing the water heater, liquid foam insulation is forced into the insulation space between the jacket and tank and allowed to cure.

The liquid heating device further includes a bottom pan and the specially configured bottom pad/foam dam member. The bottom pad/foam dam member is received in the bottom pan and has a top side with concentric first, second and third grooves formed therein and extending through closed paths, the first groove being spaced horizontally outwardly of the second and third grooves. The bottom vertical end edge portions of the jacket and the tank structure are respectively and complementarily received in the first and second grooves. Preferably, the first groove has an upwardly and horizontally outwardly sloped outer side surface which is in parallel abutment with a downwardly and horizontally inwardly sloped bottom end edge section of the jacket.

According to a key aspect of the invention, the third groove is sized to complementarily receive the bottom end edge portion of an alternate tank structure having a different horizontal dimension and utilized in place of the first-mentioned tank structure. In this manner the same bottom pad/foam dam member may be selectively incorporated in either of two differently sized liquid heating devices having similarly configured bottom vertical jacket end edge portions complementarily receivable in the first groove of the bottom pad/foam dam member. The bottom pad/foam dam member preferably has a circular, generally disc-shaped configuration and is representatively of a molded polystyrene construction, although other suitable materials could be used if desired.

DETAILED DESCRIPTION

Figure 3A:
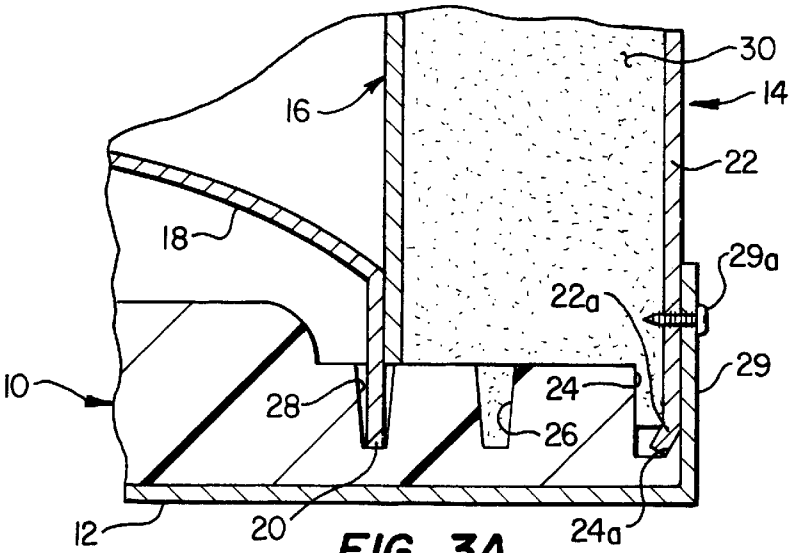
FIG. 3A is an enlarged scale detail view of the dashed circle area "3" in FIG. 1.

As illustrated in FIGS. 1–3B of the accompanying drawings, in a preferred embodiment thereof the present invention provides a specially configured circular bottom pad/foam dam member 10 which is positioned within the circular bottom pan portion 12 of a vertically oriented water heater 14 having a cylindrical configuration. Water heater 14 has a cylindrical inner tank structure 16 for storing heated water, the tank structure 16 being operatively positioned about a vertically orientable axis and having an upwardly domed bottom head portion 18 and an annular vertical bottom end lip or edge portion 20. A hollow cylindrical outer metal jacket 22 outwardly circumscribes the tank 16. Suitable heating means (not shown) are also provided for heating water disposed in the tank 16 to a predetermined set point temperature.

Bottom pad/foam dam member 10 is representatively molded from a polystyrene material, although a variety of suitable alternative materials could be used, and is generally disc-shaped. Concentric annular grooves 24,26,28 are formed in the top side of the member 10, with the groove 24 being located at the outer periphery of the member 10, the groove 26 being disposed radially inwardly of the groove 24, and the groove 28 being disposed radially inwardly of the groove 26. As best illustrated in FIGS. 3A and 3B, the groove 24 has an upwardly and horizontally outwardly sloped annular outer side surface 24*a*.

Figure 3B:
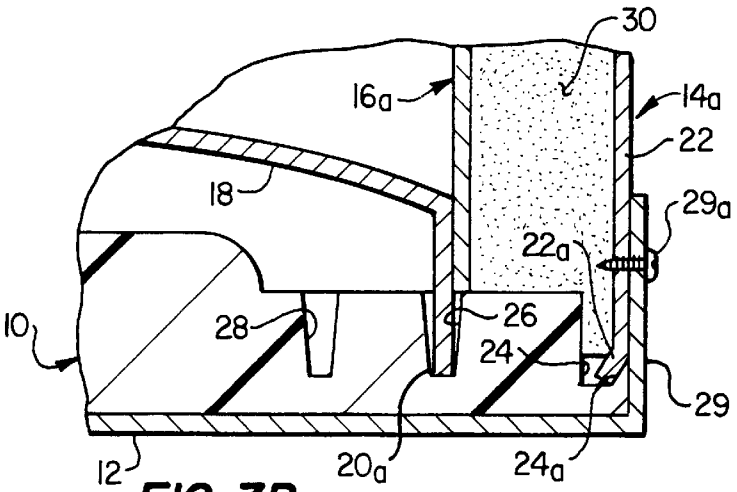
FIG. 3B is a detail view similar to that in FIG. 3A, but with a differently configured water heater operatively supported on the same bottom pad/foam dam member.
Figure 2:
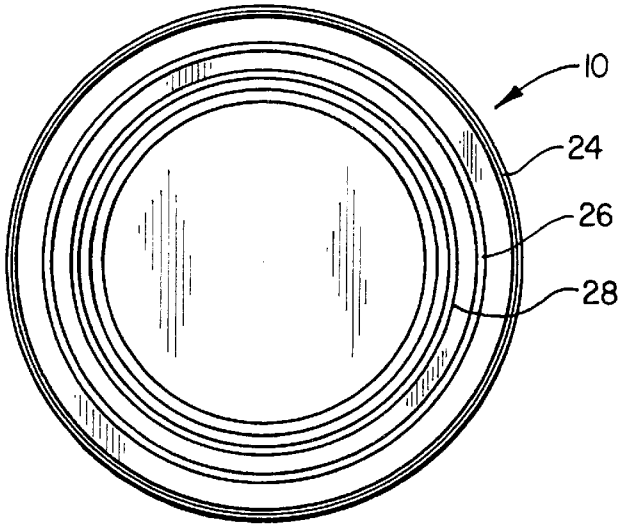
FIG. 2 is a reduced scale top plan view of the bottom pad/foam dam member removed from the water heater.
Figure 1:
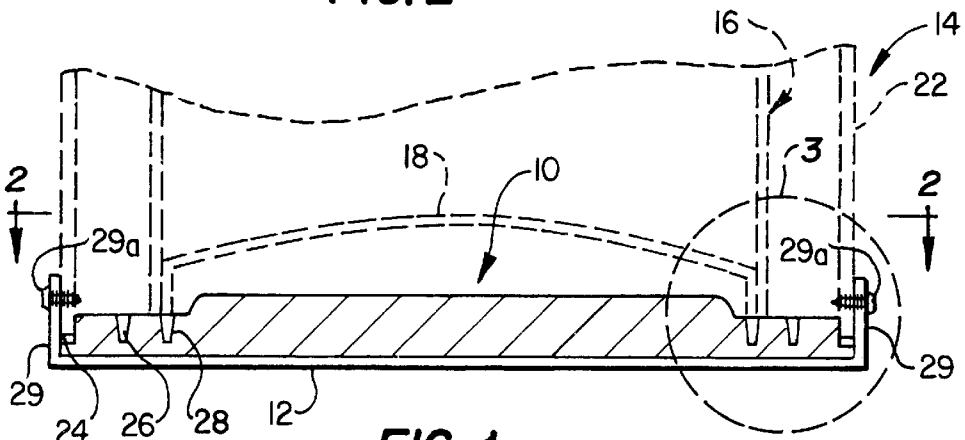
FIG. 1 is a partially phantomed simplified cross-sectional view through a bottom end portion of a representative water heater having incorporated therein a specially designed bottom pad/foam dam member embodying principles of the present invention.

In constructing the water heater 14, as shown in FIG. 3A, the bottom pad/foam dam member 10 is complementarily placed top side up in the bottom pan 12, the annular bottom end edge portion 20 of the tank 16 is downwardly placed in the innermost annular groove 28 of the pad/dam member 10, and an annular lower end edge portion of the outer metal jacket 22 is downwardly placed in the outermost annular groove 24 and suitably secured to the annular vertical side wall 29 of the bottom pan 12, as by screws 29*a*. As shown in FIG. 3A, an annular bottom end section 22*a* of the jacket 22 is downwardly and horizontally inwardly sloped parallel to the annular outer side surface 24*a* of the groove 24 and is brought into parallel abutment therewith when it bottoms out within the groove 24. Liquid foam insulation 30 is then injected into the annular space between the jacket 22 and the vertical side portion of the tank 16 and allowed to cure. The molded bottom pad/foam dam member 10, as can be seen in FIG. 3A, thus acts as a receiving and positioning base for the tank and jacket portions of the water heater, as well as serving as a dam device for preventing the injected foam insulation from being forced into the area between the top side of the pad/dam member 10 and the underside of the bottom heat portion 18 of the tank 16, and/or outwardly between the jacket 22 and the vertical side wall portion 29 of the bottom pan 12.

According to a key feature of the present invention, the pad/dam member 10 is provided with a plurality of bottom tank edge-receiving grooves (representatively the two grooves 26 and 28) to thereby uniquely permit the same pad/dam member 10 to accommodate an alternate water heater 14*a* (see FIG. 3B) which has a larger diameter tank 16*a* (with the diameter of the outer jacket 22 remaining the same). In mounting the alternate water heater 14*a* on the same pad/dam member 10, the annular bottom end edge portion 20*a* of the larger diameter tank 16*a* is placed (as shown in FIG. 3B)in the middle annular groove 26, instead of the inner groove 28, and the bottom end edge portion of the jacket 22 of the alternate water heater 14*a* is placed in the outer annular groove 24 prior to the injection of the insulation 30 between the tank 16*a* and the jacket 22. Thus, in the manufacturing process the same bottom pad/foam dam member 10 can be used with either the water heater 14 or the water heater 14*a* having the horizontally larger tank 16*a*.

A variety of modifications could be made to the bottom pad/foam dam member 10 without departing from principles of the present invention. For example, while the concentric grooves 24,26,28 have been illustrated as having circular shapes to complementarily receive their associated bottom tank and jacket end portions, they could alternatively be of other concentric closed path shapes, such as rectangular, if needed to accommodate their associated bottom tank and jacket end portions. Further, while two top side grooves (i.e., grooves 26 and 28) have been illustrated on the pad/dam member 10 to accommodate two different size tanks, it will be readily appreciated that more than two tank edge-receiving grooves could be formed in the member 10 to accommodate more than one additional tank size if desired.

Additionally, although the pad/dam member 10 has been shown as being used in conjunction with a water heater, which may be either a fuel-fired or electric water heater, the pad/dam member 10 may also be used to advantage in conjunction with other types of liquid heating apparatus such as, for example boilers, having similar bottom end configurations. Moreover, while the bottom pad/foam dam member 10 is representatively of a molded polystyrene construction, it will be readily be appreciated by those of skill in this particular art that it could be formed from a variety of other suitable materials if desired.

The foregoing detailed description is to be clearly understood as being given by way of illustration and example only, the spirit and scope of the present invention being limited solely by the appended claims.

What is claimed is:

1. A liquid heating device comprising:

a tank structure extending along a vertically orientable axis and adapted to contain a quantity of liquid to be heated, said tank structure having a bottom vertical end edge portion circumscribing said axis;

a jacket outwardly circumscribing said tank structure and forming an insulation space therebetween, said jacket having a bottom vertical end edge portion circumscribing said axis;

a bottom pan; and a bottom pad/foam dam member received in said bottom pan and having a top side with concentric first, second and third grooves formed therein and extending through closed paths, said first groove being spaced horizontally outwardly of said second and third grooves, said bottom vertical end edge portions of said jacket and said tank structure being respectively and complementarily received in said first and second grooves, and said third groove being sized to complementarily receive the bottom vertical end edge portion of an alternate tank structure having a different horizontal dimension than, and utilized in place of, said first-mentioned tank structure, whereby said bottom pad/foam dam member may be selectively incorporated in either of two differently sized liquid heating devices having similarly configured bottom vertical jacket end edge portions complementarily receivable in said first groove.

2. The liquid heating device of claim 1 wherein said liquid heating device is a water heater.

3. The liquid heating device of claim 1 further comprising a hardened foam insulation material disposed in said insulation space.

4. The liquid heating device of claim 1 wherein said first, second and third grooves have circular configurations.

5. The liquid heating device of claim 1 wherein said third groove is positioned between said first and second grooves.

6. The liquid heating device of claim 1 wherein said second groove is positioned between said first and third grooves.

7. The liquid heating device of claim 1 wherein said bottom pad/foam dam member is of a molded construction.

8. The liquid heating device of claim 1 wherein said bottom pad/foam dam member is of a molded polystyrene material.

9. The liquid heating device of claim 1 wherein said bottom pad/foam dam member has a circular, generally disc-shaped configuration.

10. A bottom pad/foam dam member upon which either selected one of a first vertically orientable liquid heating device and a second vertically orientable liquid heating device may be operatively supported, the first and second liquid heating devices each having a bottom vertical tank end edge portion outwardly circumscribed by a bottom vertical insulation jacket end portion, the bottom vertical insulation jacket end portions of the first and second liquid heating devices being substantially identical in configuration, with one of the bottom vertical tank end edge portions having a larger horizontal dimension than the other bottom vertical tank end edge portion, said bottom pad/foam dam member comprising a body portion having a top side in which concentric first, second and third grooves are formed, said first, second and third grooves extending through closed paths with said first groove being sized to complementarily receive the bottom vertical insulation jacket end portion of either of the first and second liquid heating devices, said second groove being sized to complementarily receive the bottom vertical tank end edge portion of the first liquid heating device, and said third groove being sized to complementarily receive the bottom vertical tank end edge portion of the second liquid heating device.

11. The bottom pad/foam dam member of claim 10 wherein the first and second liquid heating devices are water heaters.

12. The bottom pad/foam dam member of claim 10 wherein said first, second and third grooves have circular configurations.

13. The bottom pad/foam dam member of claim 10 wherein said bottom pad/foam dam member is of a molded construction.

14. The bottom pad/foam dam member of claim 10 wherein said bottom pad/foam dam member is of a molded polystyrene material.

15. The bottom pad/foam dam member of claim 10 wherein said body portion of said bottom pad/foam dam member has a circular, generally disc-shaped configuration.

16. The bottom pad/foam dam member of claim 15 wherein said first groove is positioned adjacent the periphery of said body portion of said bottom pad/foam dam member.

17. A method of constructing a liquid heating device comprising the steps of:

providing a bottom pan having an open top side;

providing a bottom pad/foam dam member having a top side with concentric first, second and third grooves formed therein and extending through closed paths, said first groove being spaced horizontally outwardly of said second and third grooves;

downwardly inserting said bottom pad/foam dam member into said bottom pan;

forming a first liquid heating device subassembly including a first tank structure extending along a vertically orientable first axis and adapted to contain a quantity of liquid to be heated, and a first jacket outwardly circumscribing said first tank structure and forming an insulation space therebetween, said first tank structure having a bottom vertical end edge portion circumscribing said first axis and being receivable in said first groove, said first jacket having a bottom vertical end edge portion circumscribing said first axis and being receivable in said second groove;

forming a second liquid heating device subassembly including a second tank structure extending along a vertically orientable second axis and adapted to contain a quantity of liquid to be heated, and a second jacket outwardly circumscribing said second tank structure and forming an insulation space therebetween, said second tank structure having a bottom vertical end edge portion circumscribing said second axis and being receivable in said first groove, said second jacket having a bottom vertical end edge portion circumscribing said second axis and being receivable in said third groove;

selecting either of said first and second liquid heating device subassemblies;

inserting the tank structure bottom vertical end edge portion of the selected subassembly into said first groove of said bottom pad/foam dam member; and inserting the jacket bottom vertical end edge portion of the selected subassembly into its associated one of said second and third grooves in said bottom pad/foam dam member.

18. A liquid heating device comprising:

a tank structure extending along a vertically orientable axis and adapted to contain a quantity of liquid to be heated, said tank structure having a bottom vertical end edge portion circumscribing said axis;

a jacket outwardly circumscribing said tank structure and forming an insulation space therebetween, said jacket having a bottom vertical end edge portion circumscribing said axis and having a downwardly and horizontally inwardly sloped lower end section;

a bottom pan; and a bottom pad/foam dam member received in said bottom pan and having a top side with concentric first, second and third grooves formed therein and extending through closed paths, said first groove being spaced horizontally outwardly of said second and third grooves and having an upwardly and horizontally outwardly sloped outer side surface, said bottom vertical end edge portions of said jacket and said tank structure being respectively received in said first and second grooves, with said sloped lower end section of said jacket being in a parallel abutting relationship with said sloped outer side surface of said first groove, and said third groove being sized to receive the bottom vertical end edge portion of an alternate tank structure having a different horizontal dimension than, and utilized in place of, said first-mentioned tank structure, whereby said bottom pad/foam dam member may be selectively incorporated in either of two differently sized liquid heating devices having similarly configured bottom vertical jacket end edge portions receivable in said first groove.

19. A bottom pad/foam dam member upon which either selected one of a first vertically orientable liquid heating device and a second vertically orientable liquid heating device may be operatively supported, the first and second liquid heating devices each having a bottom vertical tank end edge portion outwardly circumscribed by a bottom vertical insulation jacket end portion, the bottom vertical insulation jacket end portions of the first and second liquid heating devices being substantially identical in configuration, with one of the bottom vertical tank end edge portions having a larger horizontal dimension than the other bottom vertical tank end edge portion, said bottom pad/foam dam member comprising a body portion having a top side in which concentric first, second and third grooves are formed, said first, second and third grooves extending through closed paths with said first groove being sized to receive the bottom vertical insulation jacket end portion of either of the first and second liquid heating devices and having an upwardly and horizontally outwardly sloped outer side surface, said second groove being sized to receive the bottom vertical tank end edge portion of the first liquid heating device, and said third groove being sized to receive the bottom vertical tank end edge portion of the second liquid heating device.

* * * * *